US005557822A

United States Patent [19]

Yagi et al.

[11] Patent Number: 5,557,822

[45] Date of Patent: Sep. 24, 1996

[54] ELECTRIC VACUUM CLEANER

[75] Inventors: Mikio Yagi, Osaka; Hiroshi Mikami, Sakai; Taichi Tamura, Yao, all of Japan

[73] Assignee: Sharp Kabushiki Kaisha, Osaka, Japan

[21] Appl. No.: 321,873

[22] Filed: Oct. 14, 1994

[30] Foreign Application Priority Data

Oct. 22, 1993 [JP] Japan ..... 5-264662
Aug. 2, 1994 [JP] Japan ..... 6-181570

[51] Int. Cl.[6] ..... A47L 9/06

[52] U.S. Cl. ..... 15/369; 15/375; 15/420

[58] Field of Search ..... 15/364, 365, 368, 15/369, 375, 416, 420

[56] References Cited

U.S. PATENT DOCUMENTS

| | | | |
|---|---|---|---|
| 2,153,457 | 4/1939 | Fechtenburg . | |
| 2,846,711 | 8/1958 | Brace | 15/369 |
| 3,209,385 | 10/1965 | Bruck | 15/369 |
| 4,557,013 | 12/1985 | Belmont . | |
| 4,694,190 | 10/1990 | Murata | 15/364 |
| 4,854,006 | 8/1989 | Nishimura et al. | 15/375 |
| 5,101,534 | 4/1992 | Watanabe et al. | 15/420 |

FOREIGN PATENT DOCUMENTS

| | | | |
|---|---|---|---|
| 0553896 | 8/1993 | European Pat. Off. . | |
| 671420 | 1/1939 | Germany . | |
| 2610866 | 9/1977 | Germany . | |
| 52-124770 | 10/1977 | Japan . | |
| 52-126951 | 10/1977 | Japan . | |
| 64-6774 | 2/1989 | Japan . | |
| 538609 | 6/1993 | Japan . | |
| 107172 | 6/1916 | United Kingdom | 15/369 |
| 2086714 | 5/1982 | United Kingdom . | |
| 2214787 | 9/1989 | United Kingdom . | |

*Primary Examiner*—David Scherbel
*Assistant Examiner*—Terrence R. Till

[57] ABSTRACT

An electric vacuum cleaner having a suction nozzle comprising a dust inlet formed in a bottom surface of a nozzle body and a rotary brush rotatably mounted therein along said dust inlet, wherein said electric vacuum cleaner having either or both of configurations that said nozzle body has a flexible member mounted to a front wall thereof to rotate back and forth corresponding to the backward and forward movement of said nozzle body so that the flexible member comes in contact with a floor to cover a lower portion of said front wall, and that said nozzle body has a sliding piece slidably mounted on at least one of side walls thereof to open and close the side face corresponding to the backward and forward movement of said nozzle body.

17 Claims, 11 Drawing Sheets

Nozzle Body Moving Forward

Nozzle Body Moving Backward

ELECTRIC VACUUM CLEANER

BACKGROUND OF THE INVENTION (1) Field of the Invention

The present invention relates to an electric vacuum cleaner, more particularly to a suction nozzle for sucking dusts/dirts to collect them into a vacuum cleaner main body.

(2) Description of Prior Arts

Conventionally, as disclosed in Japanese Patent Publication Hei 5 No. 38609, a suction nozzle in use for an electric vacuum cleaner has a nozzle body 1 comprising an upper casing 2, lower casing 3 and a lid 4, a driving pipe 5 disposed at a rear portion of the nozzle body so as to be free to rotate and move up and down, and a suction pipe 6 connected to an end of the driving pipe 5 so as to be free to rotate and move left and right as shown in FIG. 1.

The lower casing 3 has a bottom surface for acting as a sled for a carpet. The lower casing 3 has a dust inlet 7 formed in a rectangle with more width than depth and is provided with front and rear wheels 8 and 9. The front and rear wheels 8 and 9 make a predetermined space between the lower casing 3 and the floor.

The nozzle body 1 has a brush chamber 11 having a rotary brush 10 rotatably disposed therein through a supporting shaft, and a communicating path 12 connecting the brush chamber 11 with the driving pipe 5. A dust suction path 13 is formed from the dust inlet 7 to the suction pipe 6. A drive motor 14 is disposed outside of the dust suction path 13 to rotate the rotary brush 10 through the belt 15. A bumper 16 for absorbing an impact against an obstacle is disposed between the upper casing 2 and the lower casing 3.

The rotary brush 10 is made from foaming resin and provided with a cleaning member 10*a* formed in a helical projection projected from the surface thereof. The rotary brush 10 is removable by taking the lid 4 off. The cleaning member 10*a* effectively scrapes dusts from a floor such as a carpet and the like by the rotation of the rotary brush 10 to introduce the dusts from the dust inlet 7 to the communicating path 12 by the suction force produced by an electric blower (not shown) of the cleaner main body to then collect the dusts into the cleaner main body through the suction pipe 6.

Flexible members 17 and 18 are disposed along the whole width of the dust inlet 7 about front and rear thereof. The flexible members 17 and 18 increase the suction force by improving the sealing performance between the dust inlet 7 and the floor. The flexible member 17 in front of the dust inlet 7 is removably mounted in a groove 19 formed in a front wall 1*a* of the nozzle body 1 by means such as a clip (not shown) and the like. The bumper 16 is disposed above the flexible member 17.

Japanese Patent Publication Sho 64 No. 6774 discloses a suction nozzle without a rotary brush, provided with a projection member 22 being movable up and down for closing a dust inlet 21 of a nozzle body 20. In this suction nozzle, the suction force thereof is increased by improving its sealing performance between the dust inlet 21 and the floor by the projection member 22. As a driving pipe 23 is positioned in a predetermined position, the projection member 22 is pushed up to open the front of the dust inlet 21. The projection member 22 is connected to the driving pipe 23 through a connecting plate 24 so that the connecting plate 24 pushes the projection member 22 upward by moving the driving pipe 23 downward. As there is any large-size solid dust, the projection member 22 is pushed upward to open the front of the dust inlet 21 to suck the dust.

In the suction nozzle as shown in FIG. 1, the flexible members 17 and 18 bend toward the dust inlet 7 by the suction force from the cleaner main body to suck dusts from spaces between them and the floor which are produced by the bendings. At a corner such as an edge of wall, the bumper 16 comes in contact with the wall surface and the flexible member 17 in front of the dust inlet is pushed toward the dust inlet 7 by a convex portion 16*a* disposed on the bumper 16 to increase the bending amount of the flexible member 17.

Though such large-size dusts such as a grain of rice, crumbs, a peanut and the like can be sucked by the space between the flexible member 17 and the floor, extremely large-size dusts such as tissues are swept forward by the flexible member 17 projecting downward so that the dusts are sucked at the verge of wall with the bumper 16 being in contact with the wall. Therefore it is difficult to suck such extremely large-size dusts into the nozzle body 1.

Each bending amounts of the flexible members 17 and 18 is changeable according to the suction force from the cleaner main body. Therefore, when there is a large-size solid dust regardless of the amount of dusts on the floor, the number of revolution of the electric blower should be increased and its operation is troublesome. The suction nozzle further has a problem that the noise of suction becomes louder.

In the suction nozzle as shown in FIG. 2, for sucking an extremely large-size dust, it is necessary to move the driving pipe 23 downward every time. That is, the user must take another action besides the normal operation for sucking dusts (moving the suction nozzle back and forth) so that the cleaning is troublesome working. The structure of the nozzle body 20 is complex so as to increase the number of parts so that the product cost is risen.

With regard to both sides of the nozzle body 1 in the width direction, the nozzle body 1 usually has cutouts (not shown) formed in side walls on the both sides thereof for a typical vacuum cleaner so as to suck dusts at a verge of wall. According to this structure, it is capable of sucking dusts at a verge of wall or a corner of a room. However, since air is always leaking from such a cutout, it is not suitable for dusts in a thick-piled carpet, in a deep groove or the like.

On the other hand, as the cutouts is closed for reducing the air leakage, the suction power of the nozzle body 1 to the floor becomes too strong for a high power type vacuum cleaner in recent years. Therefore, it is hard to operate it.

SUMMARY OF THE INVENTION

It is therefore an object of the present invention to provide an electric vacuum cleaner comprising a suction nozzle which can easily suck extremely large-size dusts by making openings large in front and/or sides of a dust inlet and can increase the suction force thereof by improving the sealing performance between the dust inlet and a floor.

The present invention is proposed in order to solve the above mentioned problem and the feature thereof is as follows:

an electric vacuum cleaner having a suction nozzle comprising a dust inlet formed in a bottom surface of a nozzle body and a rotary brush rotatably mounted therein along the dust inlet, wherein the electric vacuum cleaner having either or both of configurations that the nozzle body has a flexible member which comes in contact with a floor and covers a lower portion of said front wall and which is mounted to a front wall thereof to pivot back and forth corresponding to the backward and forward movement of said nozzle body, and that the nozzle body has a sliding piece slidably mounted on at least one of side walls thereof to open and close the side face corresponding to the backward and forward movement of the nozzle body.

In the electric vacuum cleaner structured above, it is effective that the flexible member comprises a supporting shaft pivotably mounted to the front wall of the nozzle body and a sealing piece formed in a plate shape mounted to the supporting shaft, the sliding piece comprising a slidable base portion and a plate-shaped tip portion mounted substantially vertically to the base portion, the supporting shaft and the base portion being made from hard material, and the sealing piece and the plate-shape tip portion being made from flexible material, or it is also effective that the nozzle body has a depression connecting to the dust inlet, disposed in the front wall thereof, the flexible member being detachably mounted in a groove formed in the depression.

In the electric vacuum cleaner structured above, it is effective that the nozzle body has a rear restrictive wall mounted on the front wall thereof for stopping the flexible member at an angle not to contact with the rotary brush during the backward rotation of the flexible member, and has a front restrictive wall mounted on the front wall thereof for stopping the flexible member in a state of being vertical to the floor during the forward rotation of the flexible member, or it is also effective to comprise a rear restrictive portion mounted for restricting the backward movement of the sliding piece when the side face is completely opened during the forward movement of the nozzle body and a front restrictive portion mounted for restricting the forward movement of the sliding piece when the side face is completely closed during the backward movement of the nozzle body.

In the electric vacuum cleaner structured above, it is effective to comprise a groove disposed at least either on an upper side portion or on a lower side portion of the side face portion of the side wall to slide the sliding piece along the side wall, or it is also effective that the flexible member has brushes mounted on a tip thereof, a rotational angle of the flexible member being set to contact the brushes with the rotary brush when the flexible member is stopped from rotating backward.

In a feature in the present invention, it is effective that the sealing piece of the flexible member has supplementary pieces formed in a plate shape mounted on at least both ends of a front surface thereof to connect with the sealing piece by ribs to prevent the flexible member from moving forward when the flexible member is stopped from moving backward, the supplementary pieces being set in length to come in contact with the floor, or it is also effective that brushes mounted on the plate-shaped tip portion is mounted substantially vertical to the slidable base portion, or it is also further effective to comprise brushes disposed between the sealing piece and the supplementary pieces.

In this case, it is effective that the supporting shaft of the flexible member is made from hard resin, the sealing piece of the flexible member being made from flexible resin, and the supporting shaft and the sealing piece being integrated by a two color injection, it is also effective that the base portion of the sliding piece is made from hard resin having a low coefficient of friction, the plate-shaped tip portion being made from flexible resin or hard rubber.

Since the present invention is structured above, in a case of using the suction nozzle in which the flexible member which comes in contact with a floor and covers a lower portion of the front wall and which is mounted to rotate back and forth corresponding to the backward and forward movement of the nozzle body so that the flexible member, as the suction nozzle is moved forward, the flexible member rotates backward about the supporting shaft by a friction between the flexible member and the floor. As sealing piece is moved apart from the floor, the brushes comes in contact with the floor to promote the backward rotation of the flexible member. The flexible member further rotates backward by the brushes. As the brushes are moved apart from the floor, the supplementary pieces contact with the floor. At the same time, the sealing piece comes in contact with the rear restrictive wall to stop the rotation of the flexible member. A space between the floor and the sealing piece is produced to open the front of the dust inlet widely to suck dusts from the opening.

Since the supplementary pieces are connected with the sealing piece by the ribs, the supplementary pieces are kept contacting with the floor and the sealing piece is maintained in a state of stopping the backward rotation.

In a case that the dust sucked in is a large-size solid dust, the dust encounters with the sealing piece of the flexible member. However, the sealing piece is pushed by the dust and thereby bent toward the rotary brush side since the sealing piece is flexible, so that the large-size solid dust can be smoothly sucked into the dust inlet.

As the suction nozzle is moved backward, the flexible member rotate forward against the suction force from the cleaner main body by the friction between the supplementary pieces and the floor. In this stage, the supplementary pieces do not bend because the supplementary pieces are connected with the sealing piece by the ribs so that the supplementary pieces pull the flexible member forward. The brushes then come in contact with the floor. As the brushes are moved apart from the floor, the sealing piece come in contact with the floor.

As the sealing piece comes in contact with the front restrictive and stops rotating forward, the sealing piece comes in contact with the floor. In this manner, the opening in front of the dust inlet is closed to rise the degree of vacuum under the dust inlet so as to suck dusts in a carpet and dusts in a grooved portion of a wooden floor.

Furthermore, according to another configuration of the present invention, as the suction nozzle is moved forward, the brushes of the flexible member comes in contact with the rotary brush to take off dusts twined around the surface of the rotary brush so as to reduce the number of maintenance of the rotary brush.

As the suction nozzle is moved backward, the brushes are in contact with the floor and polish the floor. In a case of a carpet, the brushes scrape dusts. Therefore, the user can effectively clean with the vacuum cleaner.

On the other hand, in a case of using the suction nozzle in which the sliding piece mounted on at least one of both sides of the suction nozzle to rotate corresponding to the backward and forward movement of the nozzle body to open and close the side face, the tip portion of the sliding piece comes in contact with the floor while the base portion slides along the groove to open and close the side face of the suction nozzle. The tip portion of the sliding piece moves within the range between the front and rear restrictive portions corresponding to the backward and forward movement of the suction nozzle to open and close the side face.

During the forward movement of the nozzle body, the side face is opened widely by a force in a backward direction from the floor by the tip portion being in contact with the floor to suck large-size dusts positioned at a verge of wall and the like into the opening.

On the other hand, during the backward movement of the nozzle body, the side face opened is closed by a force in a forward direction from the floor by a sliding of the sliding piece so that the inside of the nozzle body is in a sealing condition so as to rise the degree of vacuum thereof, thereby, to suck dusts in a thick-piled carpet, a deep grooved portion or the like. The brushes disposed on the tip portion is effective on polishing the floor.

In the configuration mentioned above, it should be understood that the vacuum cleaner may have both structures as follows; the suction nozzle body with the flexible member which is mounted on the front wall to rotate back and forth corresponding to the backward and forward movement of the nozzle body so that the flexible member comes in contact with a floor and covers a lower portion of the front wall; and the suction nozzle in which the sliding piece slidably mounted on at least one of both sides of the suction nozzle to open and close the side face corresponding to the backward and forward movement of the nozzle body. The vacuum cleaner structured above has a further improved function as a vacuum cleaner.

DESCRIPTION OF THE PREFERRED EMBODIMENTS (First Embodiment)

Figure 1:
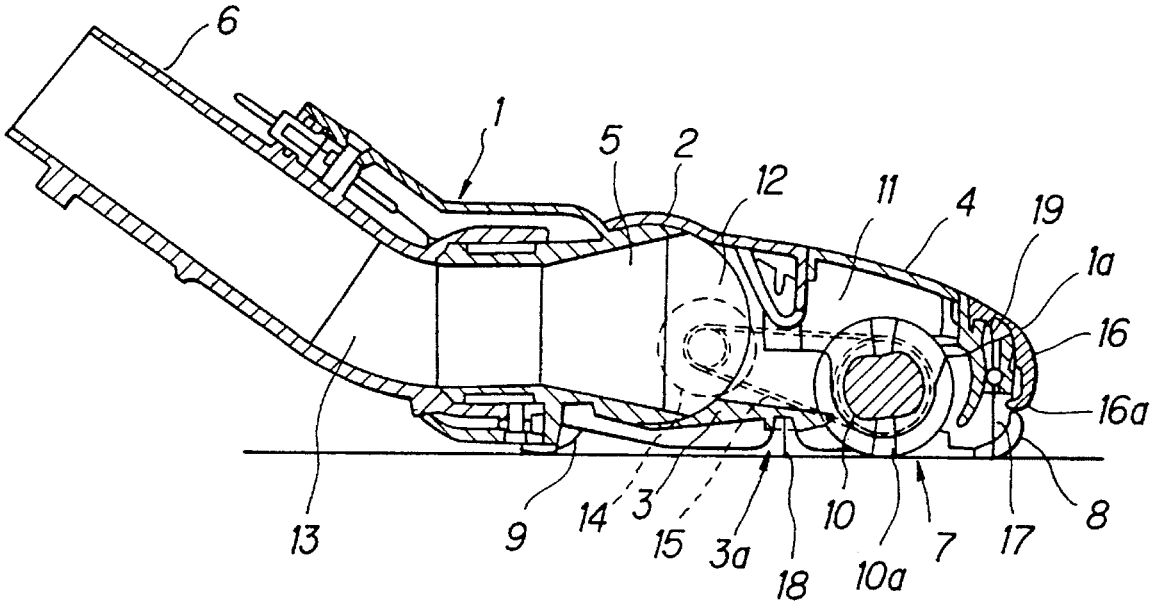
FIG. 1 PRIOR ART
FIG. 1 is a sectional view showing an example of a conventional suction nozzle in use for an electric vacuum cleaner.
Figure 2:
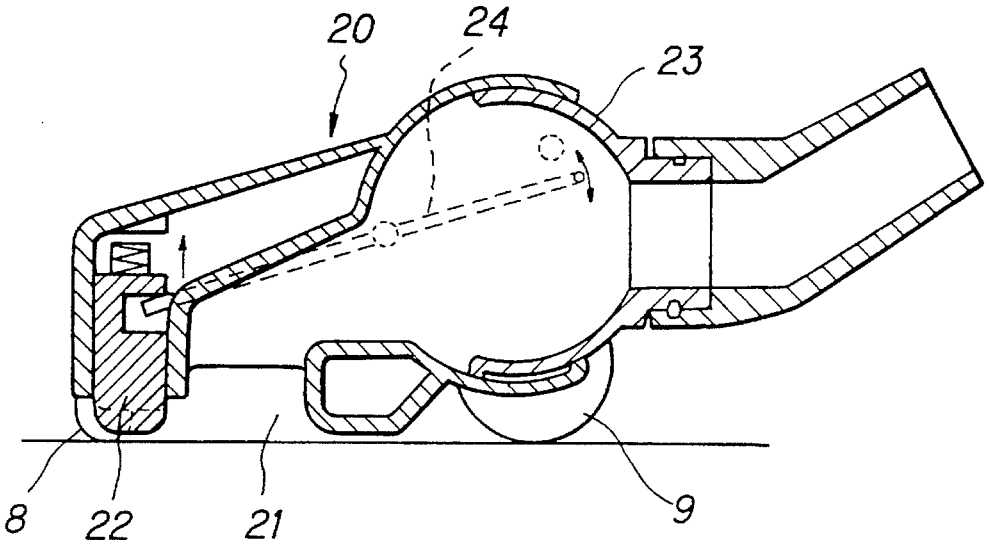
FIG. 2 PRIOR ART
FIG. 2 is a sectional view showing another example of a conventional suction nozzle in use for an electric vacuum cleaner.
Figure 3:
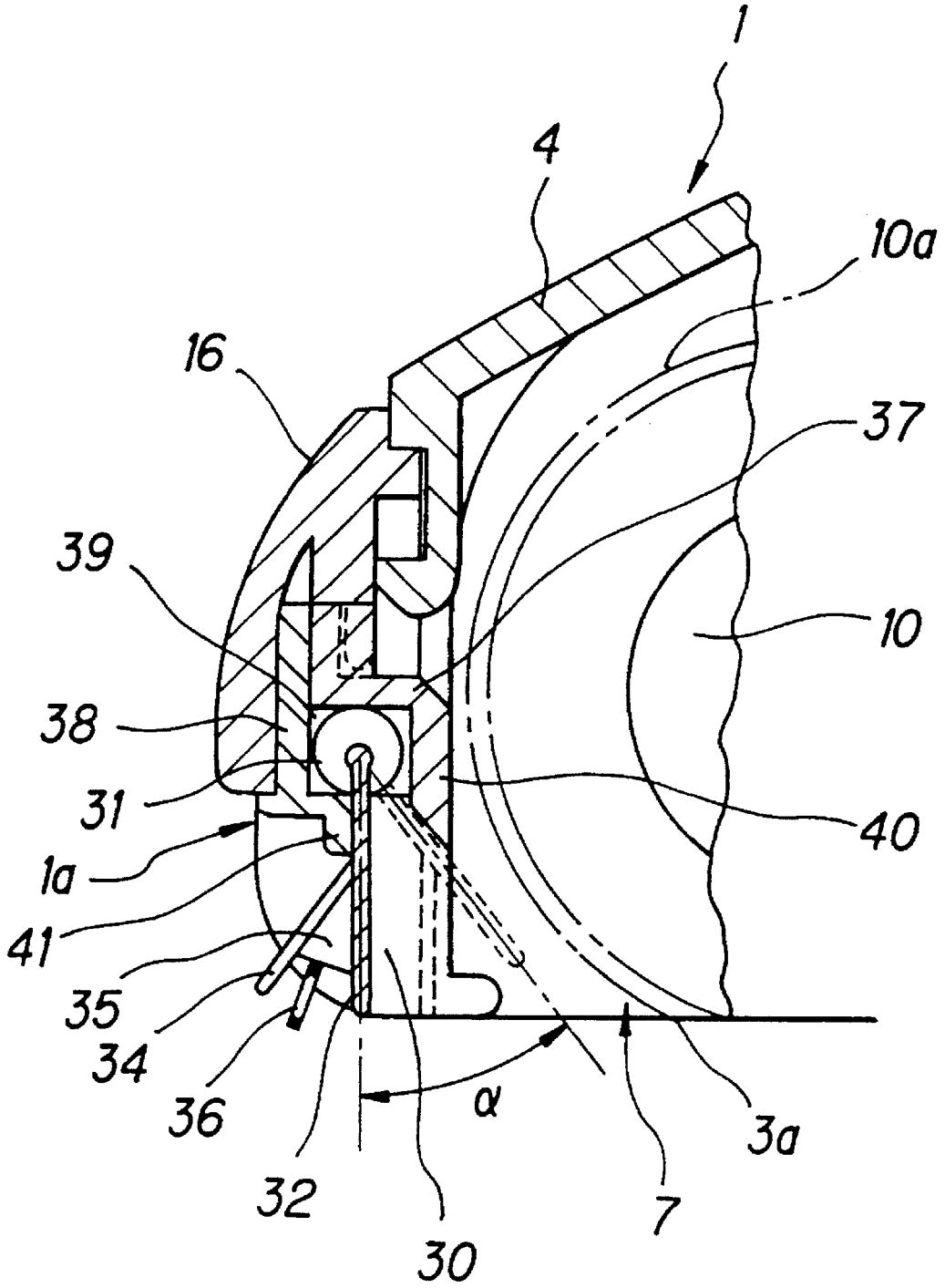
FIG. 3 is a detailed sectional view showing a nozzle body in use for an electric vacuum cleaner according to a first embodiment of the present invention.
Figure 4:
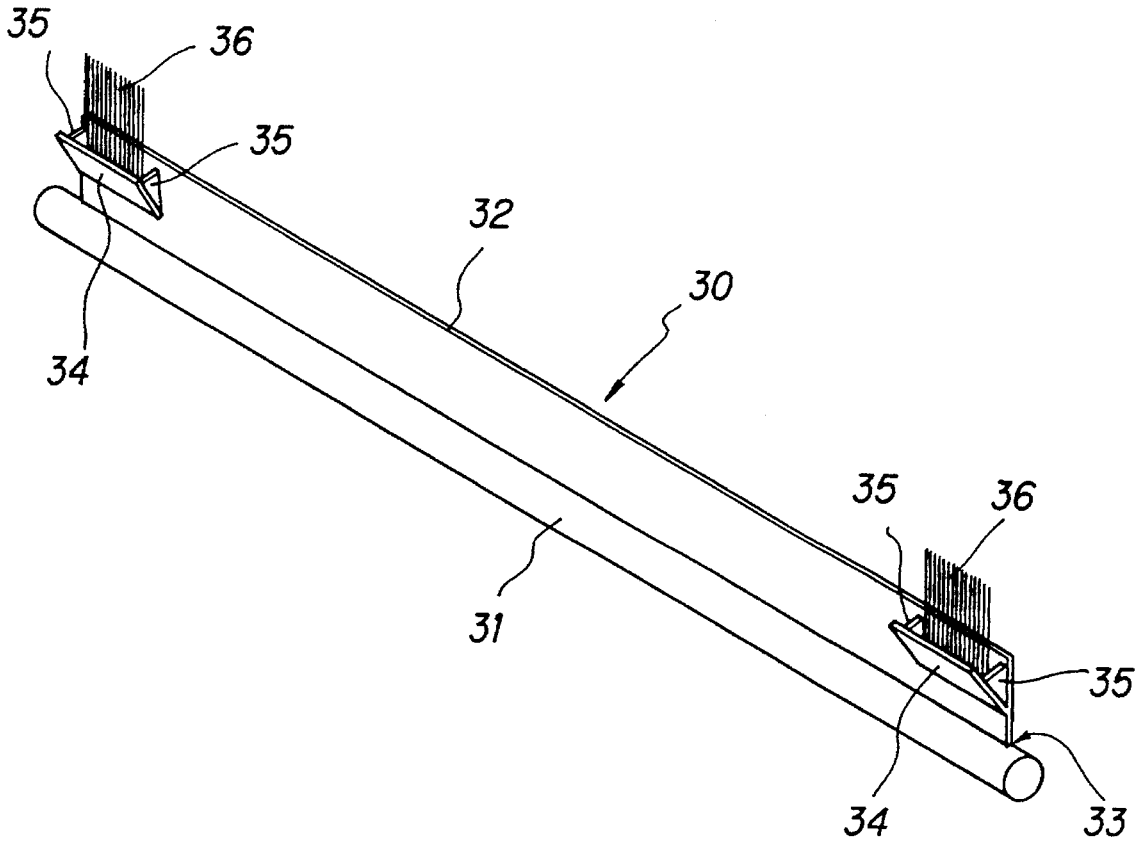
FIG. 4 is a perspective view of a flexible member according to the first embodiment.
Figure 5:
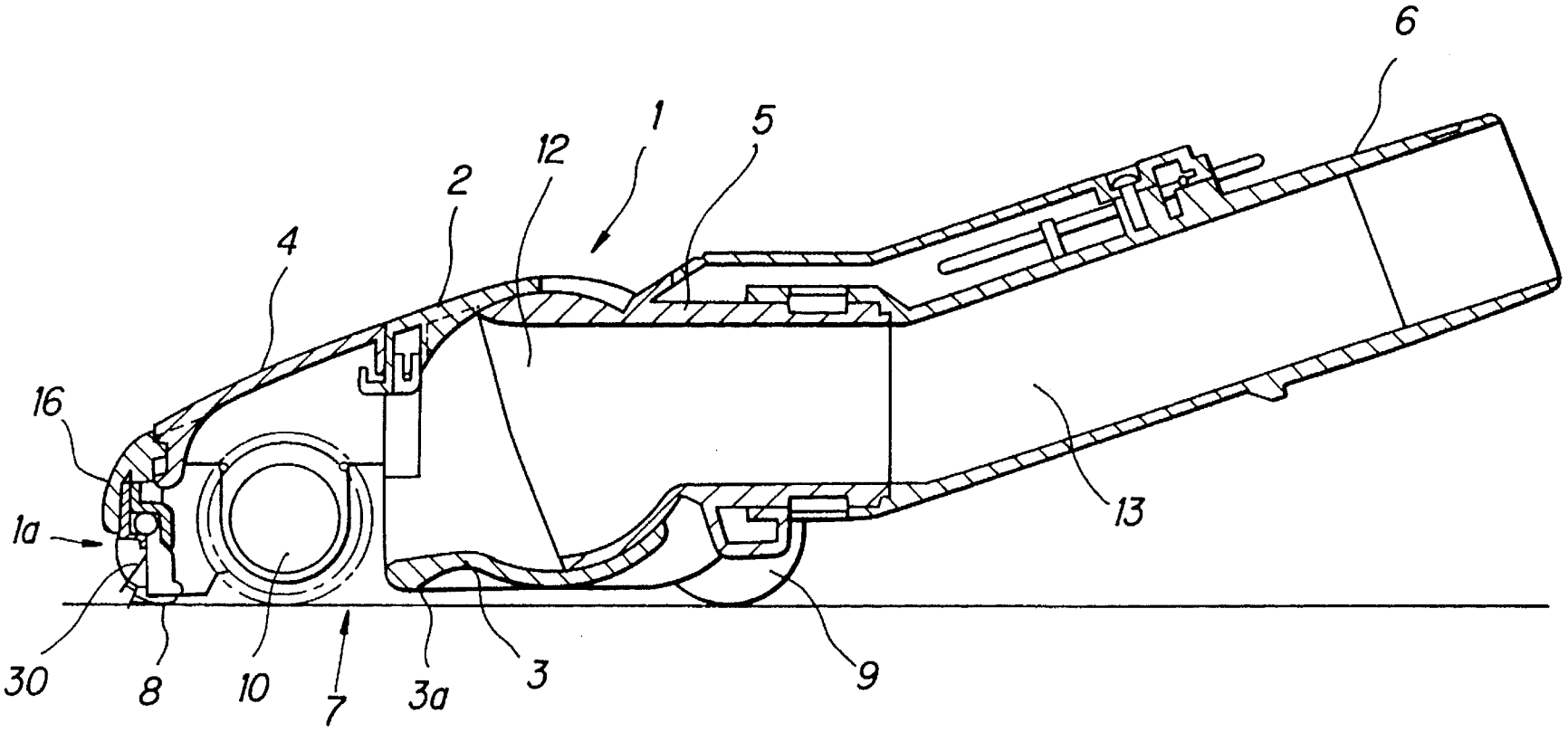
FIG. 5 is a sectional view of the nozzle body according to the first embodiment.
Figure 6:
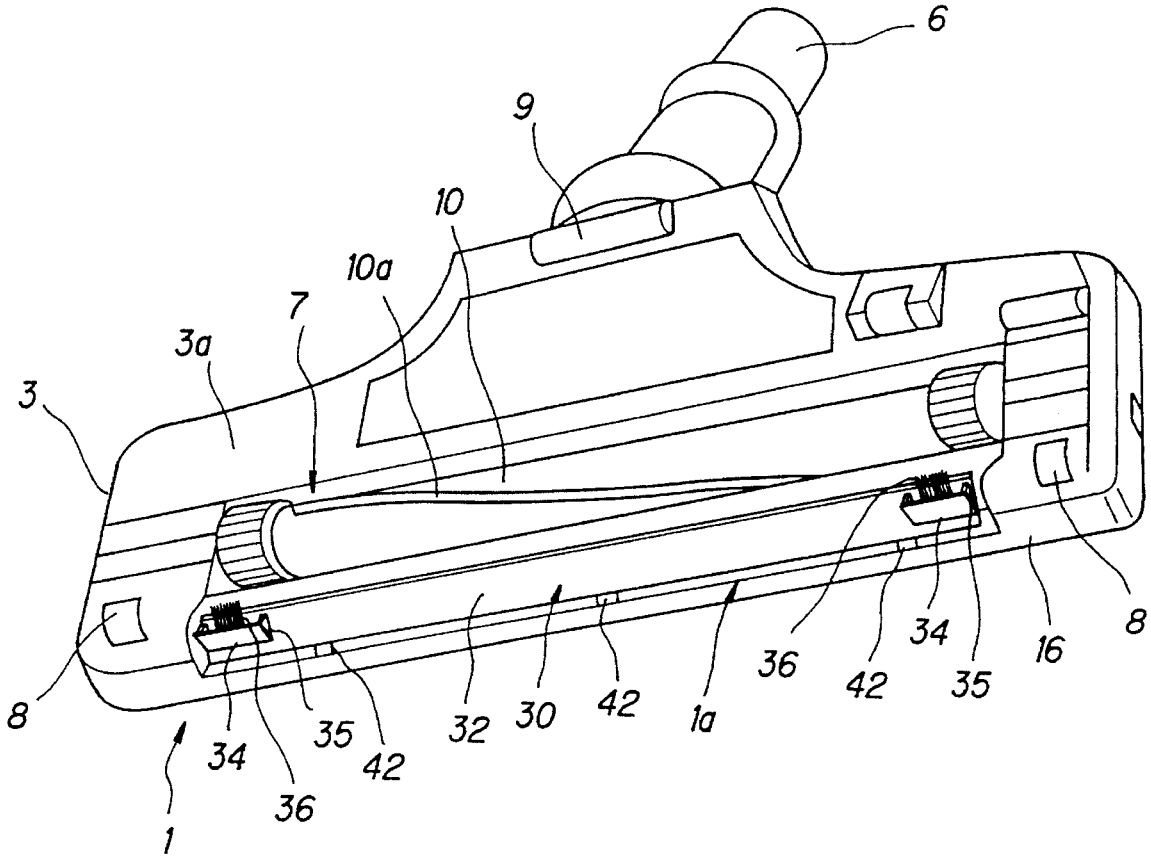
FIG. 6 is a perspective view in bottom of the nozzle body according to the first embodiment.

FIG. 3 is a detailed sectional view of a suction nozzle in use for an electric vacuum cleaner according to the first embodiment of the present invention. FIG. 4 is a perspective view of a flexible member of the first embodiment. FIG. 5 is a sectional view of the suction nozzle. FIG. 6 is a perspective view in bottom of the suction nozzle. It is understood that the same components as the conventional embodiment are designated by the same numerals.

As shown in FIGS. 5 and 6, the suction nozzle of this embodiment has a nozzle body 1 comprising an upper casing 2, lower casing 3 and a lid 4, a dust inlet 7 formed in a rectangle with more width than depth disposed on a bottom surface 3*a* of the lower casing 3, and a rotary brush 10 rotatably supported in the nozzle body 1 and facing the dust inlet 7. Since the structure of the suction nozzle is the same as the conventional embodiment, the structure will not be described in detail. In this embodiment, the description will be made as regard to portions characterized by the present invention.

In this embodiment, a flexible member 30 is disposed on a front wall 1*a* of the nozzle body 1 as shown in FIG. 3. The flexible member 30 comes in contact with the floor and covers the lower portion of the nozzle body 1. The flexible member 30 is mounted to be pivotable back and forth corresponding to the backward and forward movement of the nozzle body 1.

The flexible member 30 comprises a supporting shaft 31 pivotably mounted to the front wall 1*a* and a sealing piece 32 formed in a plate shape mounted to the supporting shaft 31 as shown in FIG. 4. The length of the supporting shaft 31 is substantially the same as one of the dust inlet 7. The supporting shaft 31 is made of hard material such as a metal bar and the like. A groove 33 is formed radially from the center of the supporting shaft 31. The sealing piece 32 is mounted in the groove 33. The length of the sealing piece 32 is substantially the same as one of the supporting shaft 31. The sealing piece 32 is made from flexible resin such as polyvinyl chloride (PVC), polyether sulphone (PES) and the like, or a flexible material such as hard rubber or even thin metal and is fitted into the groove 33 of the supporting shaft 31. The sealing piece 32 is set in width to contact the tip thereof with the floor.

The sealing piece 32 has supplementary pieces 34 disposed on the front surface thereof. The supplementary pieces 34 prevent the flexible member 30 from moving forward when the flexible member 30 is in a state of stopping the backward rotation. The supplementary pieces 34 are formed in a thin plate shape and branch at a angle to the downward from substantially the middle portion between the tip of the sealing piece 32 and the supporting shaft 31 on the both ends of the sealing piece 32, respectively. Each branch angle of the supplementary pieces 34 is set to be substantially vertical to the floor when the flexible member 30 is in a state of stopping the backward rotation. The supplementary pieces 34 are set in width to contact the tips thereof with the floor.

Each of the supplementary pieces 34 has ribs 35 disposed on the both ends thereof for connecting the supplementary piece 34 and the sealing piece 32. The ribs 35 prevent the supplementary pieces 34 from bending toward the sealing piece 32 when the tip of the supplementary 34 comes in contact with the floor.

Brushes 36 are disposed between the sealing piece 32 and each supplementary piece 34. The brushes 36 are mounted on a vertical bisector between the sealing piece 32 and each supplementary piece 34 and stand along the supplementary piece 34. The brushes 36 are set in length so that the tips of the brushes project from the tip of the sealing piece 32 and the tip of the supplementary pieces 34.

The front wall 1*a* comprises a bent plate 37 formed in a crank shape, a stopping member 38 formed substantially in a rough T-shape, and a groove 39 disposed between the bent plate 37 and the stopping member 38 as shown in FIG. 3.

The bent plate 37 has a wall 40 bent toward the dust inlet 7 and extending downward. The wall 40 is a rear restrictive wall stopping the flexible member 30 moving backward at an angle a where the flexible member 30 does not come in contact with rotary brush 10. The rear restrictive wall 40 is set in length so as to make a space between the lower end of the rear restrictive wall 40 and the floor. The space is connecting to the dust inlet 7. The lower end of the rear restrictive wall 40 is inclined downward toward the dust inlet 7 side. The flexible member 30 comes in contact with the inclined surface above mentioned to stop the flexible member 30.

The stopping member 38 is removably fitted between the bent plate 37 and the bumper 16 and has a head bent in a L-shape. A wall 41 extending downward at the dust inlet 7 side is a front restrictive wall for stopping the flexible member 30 rotating forward so that the flexible member 30 is stopped in vertical to the floor.

The flexible member 30 is removably mounted in the groove 39. The supporting shaft 31 of the flexible member 30 comes in contact with the bent plate 37 and the bumper 16 then is bent forward to put the stopping member 38 therebetween so that the supporting shaft 31 is fixed by a claw 42.

In the structure as mentioned above, as the suction nozzle is moved forward for cleaning, the flexible member 30 rotates backward about the supporting shaft 31 by a friction between the tip of the sealing piece 32 and the floor and by the suction force from the cleaner main body. As the tip of the sealing piece 32 is moved apart from the floor, the tips of the brushes 36 come in contact with the floor to promote the backward rotation of the flexible member 30. The flexible member 30 is further moved backward by the brushes 36. As the brushes 36 are moved apart from the floor, the tips of the supplementary pieces 34 come in contact with the floor. At the same time, the rear surface of the sealing piece 32 come in contact with the rear restrictive wall 40 to stop the rotation of the flexible member 30. The floor and the sealing piece 32 cooperate to produce a space therebetween so that the front of the dust inlet 7 is opened significantly. Thereby, dusts are sucked into the opening.

At the same time, since the supplementary pieces 34 are connected with the sealing piece 32 by the ribs 35, the tips of the supplementary pieces 34 are kept being in contact with the floor so as to maintain the sealing piece 32 stopping the backward rotation thereof. In addition, the suction force from the cleaner main body prevents the flexible member 30 from rotating forward.

The large-size solid dust sucked is encountered with the sealing piece 32 of the flexible member 30. Since the sealing piece 32 is flexible, the sealing piece 32 is then pushed by the large-size solid dust so as to be bent to the rotary brush 10 side so that the large-size solid dust is smoothly sucked into the dust inlet 7 and then introduced from the dust inlet 7 to the cleaner main body through the suction pipe 6.

As the suction nozzle is moved backward, the flexible member 30 rotates forward against the suction force from the cleaner main body by the friction between the supplementary pieces 34 and the floor. At this time, the flexible member 30 is pulled forward without a distortion of the supplementary pieces 34 since the supplementary pieces 34 are connected with the sealing piece 32 by the ribs 35. The brushes 36 then contact with the floor. As the brushes 36 are moved apart from the floor, the front surface of the sealing piece 32 comes in contact with the front restrictive wall 41 to stop the forward rotation thereby, the sealing piece 32 comes in contact with the floor.

The opening in front of the dust inlet 7 is sealed by the sealing piece 32 to increase the degree of vacuum under the dust inlet 7 so as to suck dusts in the carpet or dusts in a grooved portion of the floor.

In this manner, the flexible member 30 rotates corresponding to the backward and forward movement of the nozzle body 1. Therefore, the front of the dust inlet 7 can be closed or opened only by moving the nozzle body 1 back and forth. Consequently, the flexible member 30 rotates backward to open the front of the dust inlet 7 during moving forward so as to easily suck large-size solid dusts such as peanuts and tissues and dusts on the corner such as a verge of wall completely. The bottom surface 3*a* does not adhere to the floor because of the opening in front of the dust inlet 7 so that the user can operate conveniently. On the other hand, the flexible member 30 rotates forward to close the front of the dust inlet 7 during moving backward to rise the degree of vacuum under the dust inlet 7 to provide a strong suction force so as to suck dusts in the carpet or dusts in a grooved portion of the floor.

Since the rear restrictive wall 40 disposed on the front wall 1*a* restricts a backward rotation of the flexible member 30, the sealing piece 32 stops rotating immediately in front of the rotary brush 10 so as to prevent the sealing piece 32 from coming in contact with the rotary brush 10. Therefore, the cleaner can provide a stable suction force at the dust inlet 7 since the opening in front of the dust inlet 7 is uniformly opened regardless of the suction force from the cleaner main body. Since the tip of the sealing piece 32 covers a part of the dust inlet 7 to reduce the opening area of the dust inlet 7, the suction force at the dust inlet 7 becomes enhanced so as to easily suck large-size solid dusts such as peanuts and tissues. In a case of a thick-piled carpet such as a shaggy carpet, the nozzle body moves forward with the sealing piece 32 keeping to push the piles of the carpet so as to prevent the rotary brush 10 from twining the piles of the carpet.

Since the front restrictive wall 41 of the front wall 1*a* restricts a forward rotation of the flexible member 30, the sealing piece 32 becomes vertically to the floor so as to enhance the suction force under the dust inlet 7 of which the front is sealed.

In addition, since the flexible member 30 is mounted in the groove of the front wall la, the width of the sealing piece 32 can be set to be wider so that the sealing piece 32 becomes easy to bend. This can reduce the friction resistance between the sealing piece 32 and the floor during the backward and forward rotation of the flexible member 30 so that the user can operate conveniently without influence to the operation of the nozzle body 1. In addition, the flexible member 30 is mounted removably so as to easily exchange and maintain the flexible member 30.

(Second Embodiment)

Figure 7:
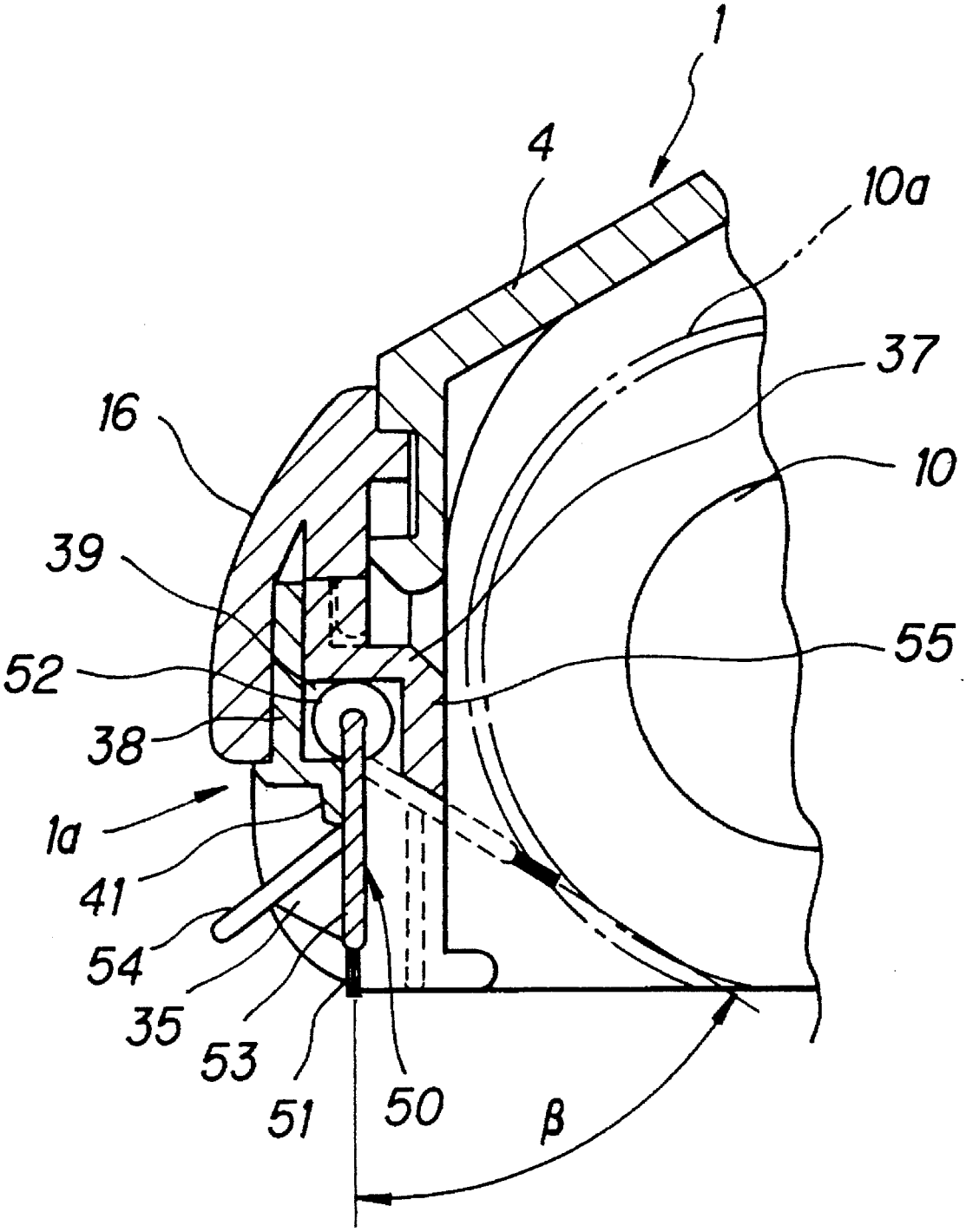
FIG. 7 is a detailed sectional view showing a nozzle body in use for an electric vacuum cleaner according to a second embodiment of the present invention.
Figure 8:
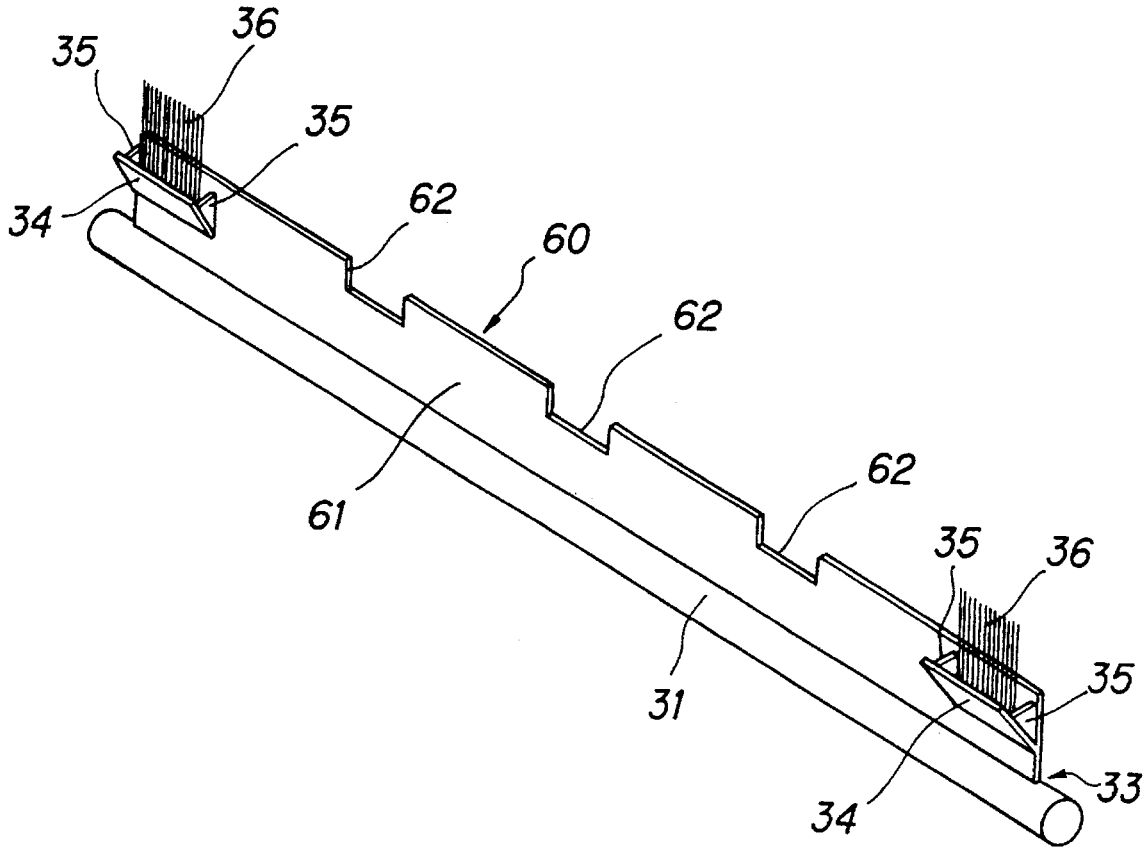
FIG. 8 is a perspective view showing a flexible member according to another embodiment, corresponding to the flexible member of the first embodiment as shown in FIG. 4.

In a suction nozzle of this embodiment, the nozzle body 1 has a flexible member 50 rotatably mounted to the front wall 1*a* thereof as shown in FIG. 7. The flexible member 50 has brushes 51 disposed on the tip thereof. The rotational angle β of the flexible member 50 is set to contact the brushes 51 with the rotary brush 10 when the flexible member 50 is in a state of stopping the backward rotation.

The flexible member 50 comprises a supporting shaft 52 pivotably mounted to the front wall la, a sealing piece 53 mounted to the supporting shaft 52 and supplementary pieces 54 branching at a angle of downward on the both sides of the sealing piece 53. The sealing piece 53 is set in width to make a space between the floor and the tip thereof. The brushes stand on the tip of the sealing piece 53 so that the tips of the brushes comes in contact with the floor.

A lower end surface of a rear restrictive wall 55 disposed on the front wall 1*a* is inclined at an angle of β so that the tips of the brushes 51 of the flexible member 50 come in contact with the cleaning member 10*a* of the rotary brush 10. Each branch angle of the supplementary pieces 54 is set to be substantially vertical to the floor when the flexible member 50 is in a state of stopping the backward rotation. This embodiment has same components as the first embodiment except that the brushes 36 are not disposed between the supplementary pieces 54 and the sealing piece 53 in this embodiment.

As the suction nozzle is moved forward, the flexible member 50 rotates backward to contact the brushes 51 with the cleaning member 10*a* of the rotary brush 10 so as to take off dusts twined around the surface of the cleaning member 10*a*. Therefore, the rotary brush 10 is always maintained to be clean so as to reduce the frequency of maintenance of the rotary brush 10. If the cleaning member 10*a* is used for polishing the floor, it can improve a polishing efficiency thereof.

When the suction nozzle is moved backward, the brushes 51 come in contact with the floor so as to increase the efficiencies of polishing a floor and scraping dusts a carpet and the like.

It will be obvious that the above embodiments are intended to cover any modification or changes as may come within the scope of the invention.

For example, though the above description in the first and second embodiments are made as regard to the suction nozzle with a power brush for a canister type vacuum cleaner in which the rotary brush 10 is rotated by the drive motor 14, an air turbine brush or the like may be employed in the suction nozzle, and the suction nozzle may be used for an upright type vacuum cleaner instead of the canister type vacuum cleaner.

When the supporting shaft 31 or 52 of the flexible member 30 or 50 is made from hard resin such as polystyrene (PS), polycarbonate (PC) and the like and is integrated by a two color injection with the sealing piece 32 or 53 made from flexible resin such as PVC, PES and the like, the number of steps for producing the parts can be reduced so as to lower the cost.

Further, the positions of the supplementary pieces 34 or 54 disposed on the sealing piece 32 or 53 of the flexible member 30 or 50 in the above embodiment are not confined to at the both sides of the sealing piece 32 or 53.

Furthermore, a sealing piece 61 of a flexible member 60 is provided with a plurality of cutouts 62 so as to provide more enhanced suction force at the opening in front of the dust inlet 7.

(Third Embodiment)

Figure 9:
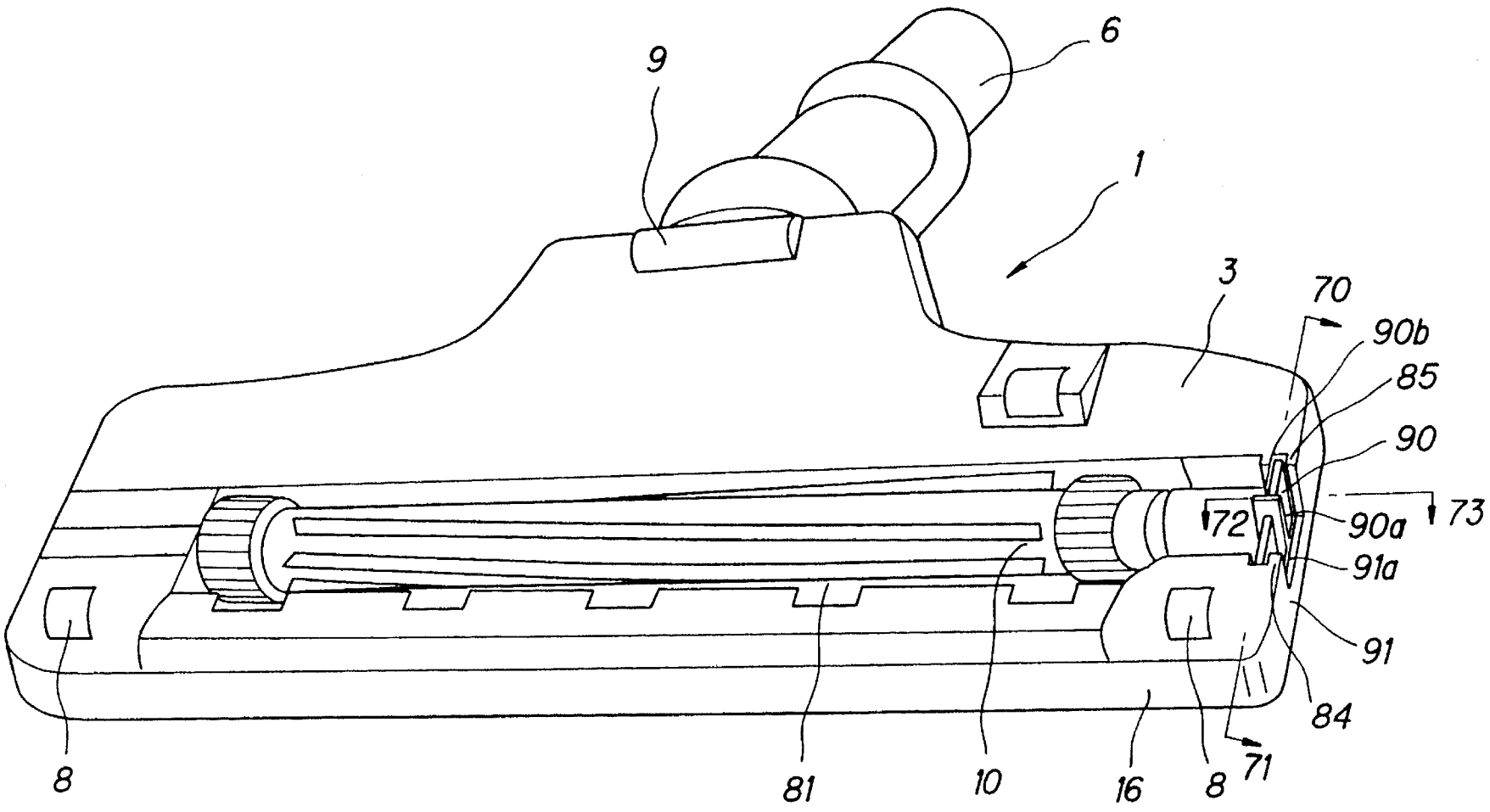
FIG. 9 is a perspective view in bottom of a nozzle body in use for an electric vacuum cleaner according to a third embodiment of the present invention.
Figure 10:
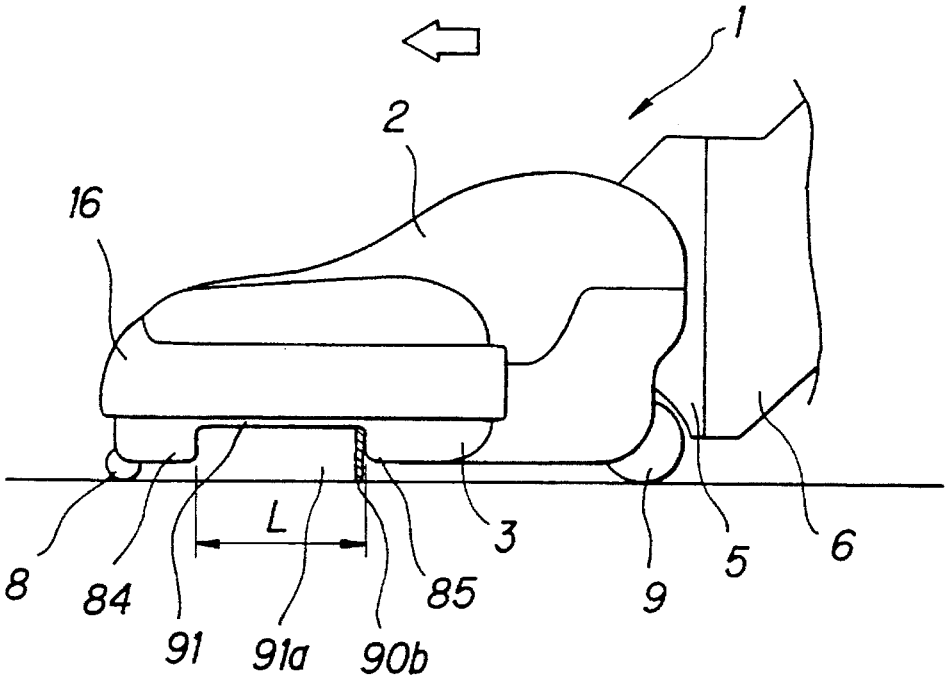
FIG. 10 is a side view of the nozzle body of the third embodiment during moving forward.
Figure 11:
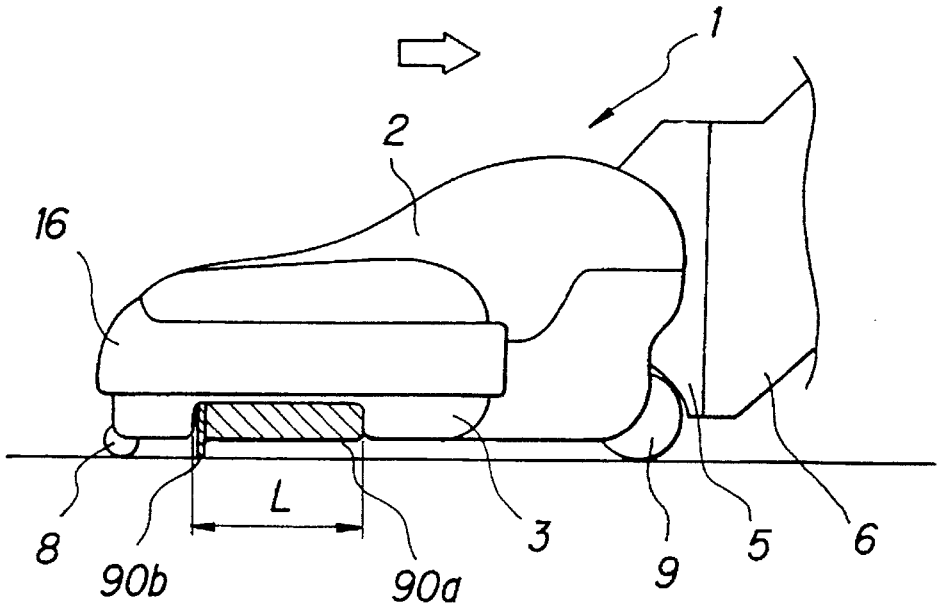
FIG. 11 is a side view of the nozzle body of the third embodiment during moving backward.
Figure 12B:
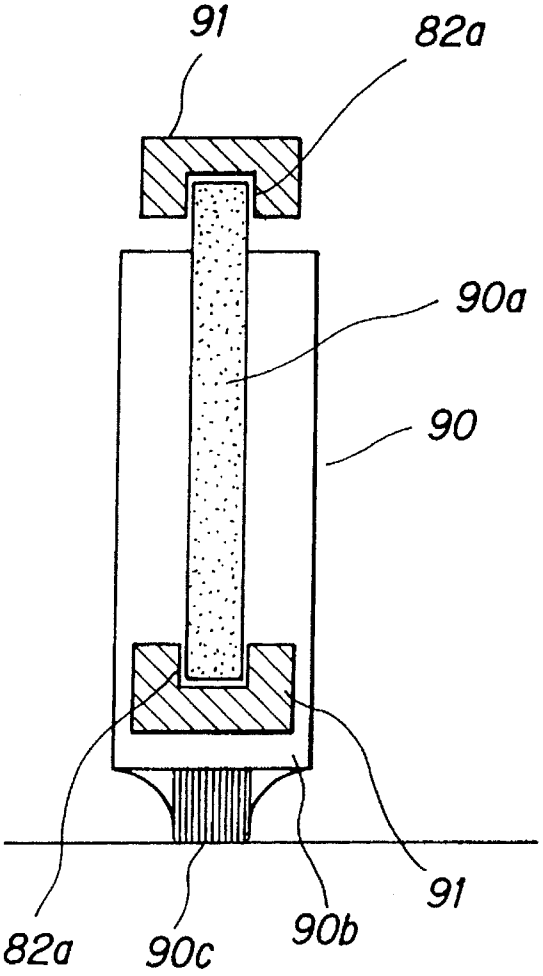
FIG. 12B is an explanatory view showing a section taken along the line 72–73 shown in FIG. 9; and, FIG. 13 is a perspective view in bottom of a nozzle body in use for an electric vacuum cleaner according to a fourth embodiment of the present invention.
Figure 12A:
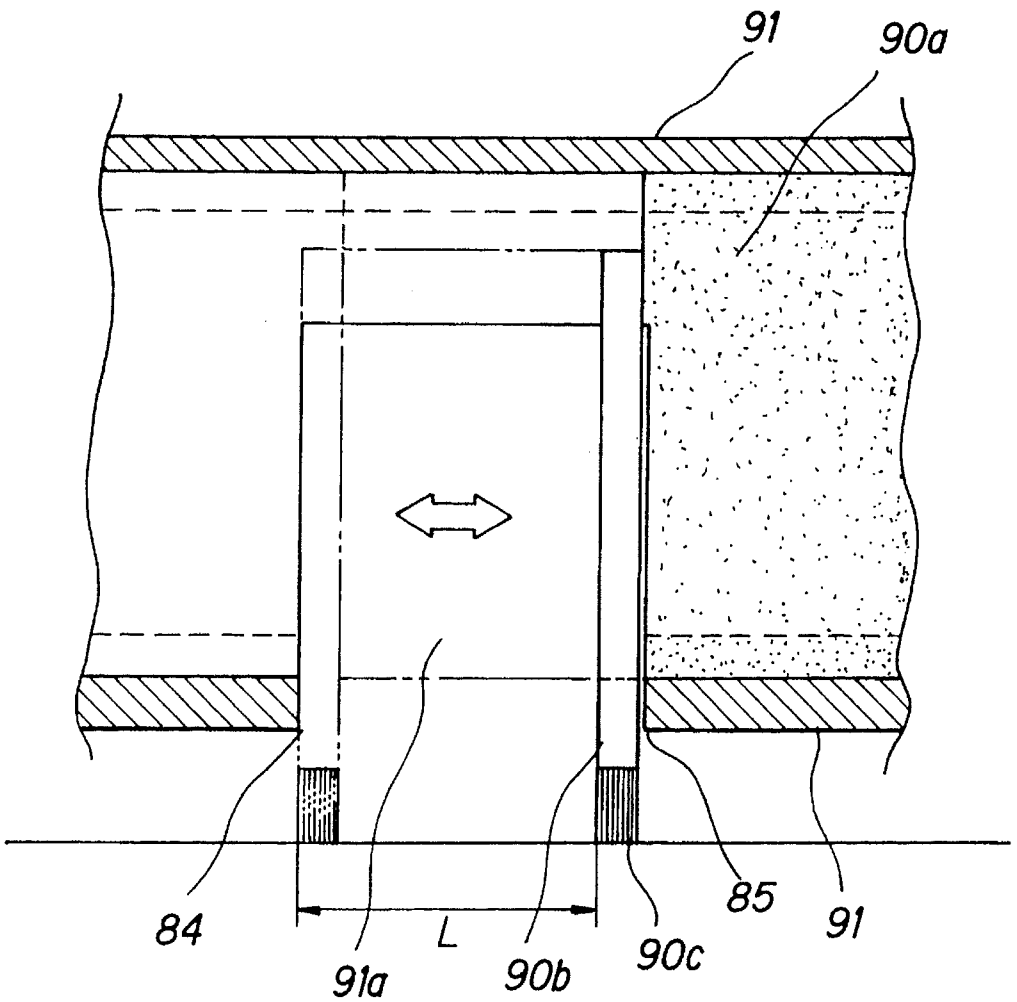
FIG. 12A is an explanatory view showing a section taken along the line 70–71 shown in FIG. 9.

FIG. 9 is a perspective view in bottom of a nozzle body in use for an electric vacuum cleaner according to the third embodiment of the present invention. FIG. 10 is a side view of the nozzle body of the embodiment shown in FIG. 9 during moving forward. FIG. 11 is a side view of the nozzle body of the embodiment shown in FIG. 9 during moving backward. FIG. 12A is an explanatory view showing a section taken along the line 70–71 shown in FIG. 9. FIG. 12B is an explanatory view showing a section taken along the line 72–73 shown in FIG. 9. The same components of the suction nozzle as the conventional embodiment are designated by the same numerals. The based components of the nozzle body will not be described since the components are the same as one of the conventional embodiment.

As shown in FIGS. 9 through 12 described above, in the nozzle body 1 used in the third embodiment, a cutout 91*a* is disposed at least on one of side walls 91 of the nozzle body 1. The cutout 91*a* can be opened and closed by a sliding piece 90. That is, the side surface of the nozzle body 1 can be opened and closed by the sliding of the sliding piece 90. The sliding piece 90 has a base portion 90*a* made from hard material. The base portion 90*a* slides along the groove portions 82*a* disposed above and under the cutout 91*a* of the side wall 91 of the lower casing 3. A tip portion 90*b* formed in a plate shape having flexibility is mounted to be substantially vertical to the base plate 90*a*. Preferably, the tip portion 90*b* has brushes 90*c* about a portion where it comes in contact with the floor.

In this case, it is effective that the base plate 90 is made from resin such as polystyrene (PS), polycarbonate (PC) and the like, more preferably is made from hard synthetic resin having a low coefficient of friction and that the tip portion 90*b* formed in a plate shape, particularly in a thin plate shape is made from flexible resin such as polyvinyl chloride (PVC), polyether sulphone (PES) and the like or flexible material such as hard rubber.

By using the resin material having low coefficient of friction to the base portion 90*a*, the sliding piece 90 can smoothly slides. By mounting the brushes 90*c* about the portion where the tip portion 90*b* formed in a plate shape having flexibility comes in contact with the floor, a polishing (brushing) efficiency to the floor is improved.

The groove portion 82*a* on which the sliding piece 90 slides may be disposed at least either above or under the cutout 91*a* so that the sliding piece 90 can slides without any trouble. As shown in FIGS. 10–12A, B, the sliding piece 90 slides within the range L of the cutout 91*a* mounted to the side wall 91 of the nozzle body to open or close the cutout 91*a*. When the cutout 91*a* as an opening is opened completely during the forward movement of the nozzle body 1, a rear restrictive portion 85 for restricting the backward movement of the sliding piece 90 is positioned about the lower end of the cutout 91*a* of the side wall 91 and is in contact with the flexible tip 90*b* mounted substantially vertically to the sliding base portion 90*a* so as to restrict the position. When the cutout 91*a* as an opening is closed completely during the backward movement of the nozzle body 1, a front restrictive portion 84 for restricting the forward movement of the sliding piece 90 is positioned about the lower end of the cutout 91*a* of the side wall 91 and is in contact with the flexible tip 90*b* mounted substantially vertically to the base portion 90*a* the sliding piece 90 so as to restrict the position.

Referring to FIGS. 9–12A, B, the description will now be made as regard to an operation of an electric vacuum cleaner according to the third embodiment of the present invention.

According to the configuration described above, when the nozzle body 1 is moved forward, the flexible tip 90*b* being in contact with the floor by the brushes 90*c* slides the sliding piece 90 backward by receiving a force from the floor in a backward direction and moves backward to the end of the range L to be restricted at the position of the rear restrictive portion 85. Thereby the cutout 91*a* is opened to connect the bottom opening 81 shown in FIG. 9 showing the bottom of the nozzle body 1 and the cutout 91*a* so as to produce an air leakage. Therefore, the air quantity of the electric vacuum cleaner is collected to the side surface so as to suck large-size dusts such as peanuts remaining at a side, a corner, or a verge of wall by this air quantity into the cleaner main body. In this manner, it is capable of sucking dusts completely through the bottom opening 81 smoothly.

When the suction opening 1 is moved backward, on the contrary to the case described above, the sliding piece 90 slides forward by the flexible tip 90*b* receiving a force from the floor in a backward direction and moves forward to the other end of the range L to be restricted at the position of the front restrictive portion 84. Thereby the cutout 91*a* is closed to rise the degree of vacuum in the nozzle body 1 so as to enhance the suction force from the bottom opening 81. Therefore it is effective to suck dusts such as sands disposed deeply in a carpet, in particularly, a thick-piled carpet, further to suck dust in the groove formed in a wooden floor.

The effects in moving the nozzle body 1 back and forth are that the electric vacuum cleaner of this embodiment can suck large-size dust such as peanuts and dusts at a verge of wall and a corner during the forward movement, and can suck dusts disposed deeply in a carpet and a groove formed in the wooden floor during the backward movement.

In the electric vacuum cleaner of the present invention, the sliding piece 90 is disposed at least on one of the side walls of the nozzle body 1, that is, it will be obvious that two sliding pieces 90 may be disposed on the both side walls, respectively so as to further increase the air leakage due to the opening 81 and cutouts 91*a*. Thereby, the maneuverability of the nozzle body 1 is further improved.

In this case, though the range L of the cutout 91*a* is usually set to be the same as the width of the opening 81, the range L may be set to be wider so as to increase the air leakage so that the maneuverability of the nozzle body 1 during the forward movement is extremely improved.

(Fourth Embodiment)

In the present invention, the suction nozzle may have both of two configurations or at least either one of configuration in which the flexible member covered the lower portion of the front wall of the nozzle body is mounted to the front wall to rotate back and forth corresponding to the backward and forward movement of the nozzle body, or a configuration in which the sliding piece which is slidable is disposed at least on one of the side walls of the nozzle body to open and close the side surface corresponding to the backward and forward movement of the nozzle body. The above mentioned embodiments demonstrated the suction nozzles with either one of the above configurations.

Figure 13:
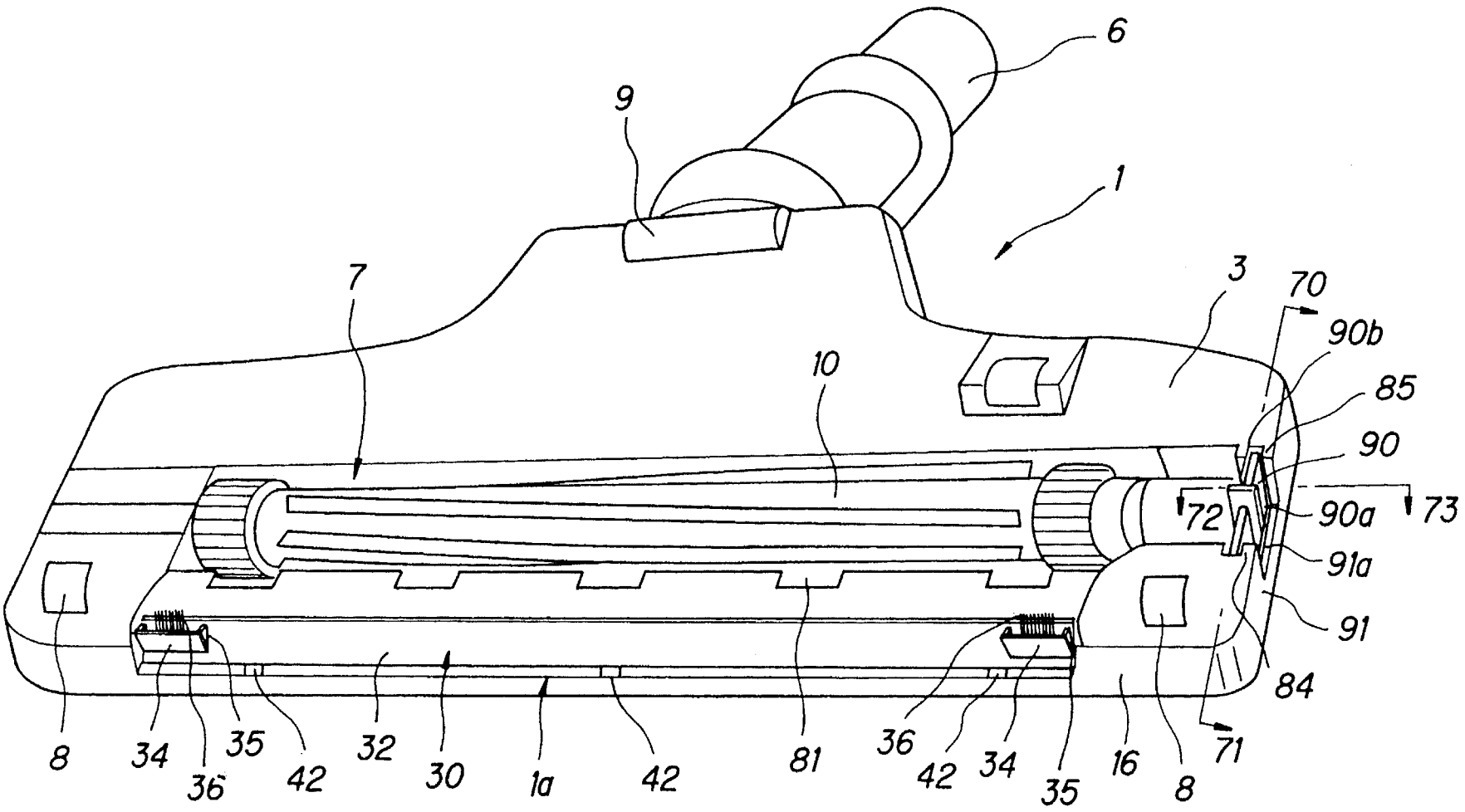

This embodiment exemplifies a suction nozzle having both configurations mentioned above. FIG. 13 is a perspective view in bottom of a nozzle body in use for an electric vacuum cleaner according to a fourth embodiment of the present invention. In FIG. 13, the components are designated by the same numerals of FIG. 6 and FIG. 9. A sectional view taken along the line 70–71 shown in FIG. 13 and a sectional view taken along the line 72–73 shown in FIG. 13 are the same as FIG. 12A and FIG. 12B, respectively. Therefore, the components and operation of the suction nozzle of this embodiment will not described.

According to the structure as shown in FIG. 13, the electric vacuum cleaner has the efficiency of sucking which the electric vacuum cleaner of the first embodiment as shown in FIG. 6 can perform by opening and sealing the dust inlet 7 of the nozzle body 1, the increase in the air quantity and the efficiency of sucking dusts at a verge of wall and a corner which the electric vacuum cleaner of the third embodiment as shown in FIGS. 12A and 12B can perform by opening and closing the cutout 91*a* of the side wall 91 of the nozzle body 1, and furthermore superimposed efficiencies thereof. Therefore, it can provide a further excellent electric vacuum cleaner.

As mentioned above, it will be obvious that the above embodiments are intended to cover any modification or changes as may come within the scope of the invention.

For example, the third embodiment and the fourth embodiment can be applied to a nozzle body of which a rotary brush 10 is an air turbine brush besides a power brush driven by a driving means, or to any other kind of nozzle bodies. These embodiments can be also applied to a typical electric vacuum cleaner having a nozzle body without a rotary brush. Thereby, the effectiveness of suction of the electric vacuum cleaner is improved and the sticking between the floor and the nozzle body during a forward movement of the vacuum cleaner is prevented so that the maneuverability thereof becomes agile.

As apparent from the above description, according to the present invention, the front or the side wall of the dust inlet can be opened or closed by the rotation of the flexible member or the sliding of the sliding piece corresponding to the backward and forward movement of the nozzle body only by moving the nozzle body back and forth. Therefore, the flexible member rotates backward or the sliding piece slides backward during the backward and forward movement of the nozzle body to open the front and side face of the dust inlet widely so as to suck a large-size solid dust such as peanuts and tissues through the opening thereof and suck dusts on the corner such as a verge of wall completely. The flexible member rotates forward or the sliding piece slides forward during the forward movement of the nozzle body to close the front and side surface of the dust inlet so as to rise the degree of vacuum under the dust inlet to provide an enhanced suction force.

In addition, even if the large-size solid dust sucked encounters with the sealing piece of the flexible member, the sealing piece is pushed by the large-size solid dust to bend toward the rotary brush side so as to smoothly suck the large-size solid dust into the dust inlet. Furthermore, the friction resistance between the flexible member and the floor is reduced so that it may not influence the maneuverability of the nozzle body.

According to the present invention, since the flexible member is mounted in the groove of the front wall of the nozzle body, the width of the flexible member can be set to be wider so that the flexible member becomes easy to bend. This can reduce the friction resistance between the flexible member and the floor which is produced during the backward and forward rotation of the flexible member so that the user can perform cleaning agilly without giving influence to the movement of the suction nozzle. In addition, the flexible member is detachably mounted so as to be subjected to easy exchange and maintainance of the flexible member.

Further, according to the present invention, since the rear restrictive wall is mounted on the front wall to restrict the backward rotation of the flexible member, the flexible member stops rotating immediately in front of the rotary brush so as to prevent the flexible member from encountering with the rotary brush. Therefore, the cleaner can provide an uniform suction force at the dust inlet since the opening in front of the dust inlet is uniformly opened regardless of the suction force from the cleaner main body. Since the flexible member covers a part of the dust inlet to reduce the opening area of the dust inlet, the suction force at the dust inlet becomes enhanced so as to easily suck large-size solid dusts such as peanuts and tissues. Furthermore, in a case of a thick-piled carpet such as a shaggy carpet, the body moves forward with the flexible member keeping to push the piles of the carpet so as to prevent the rotary brush from twining of the piles of the carpet.

Since the front restrictive wall of the front wall restricts a forward rotation of the flexible member, the flexible member becomes vertical to the floor so as to enhance the suction force under the dust inlet of which the front is sealed. Therefore, the vacuum cleaner can suck dusts in a carpet and dusts at a portion grooved in the wooden floor.

Furthermore, according to the present invention, since the supplementary piece is connected with the sealing piece by ribs to increase the rigidity of the supplementary piece so that the supplementary piece is not bent. Thereby, the supplementary piece can maintain the sealing piece in a state of stopping the backward rotation during the backward rotation of the flexible member, and can rotate the sealing piece forward against the suction force from the vacuum cleaner main body during the forward movement of the flexible member. Therefore, the flexible member can rotate back and forth surely and smoothly. The brushes are disposed to promote the backward and forward rotation of the flexible member so as to effectively clean portions about the both ends of the dust inlet.

According to the present invention, the brushes of the flexible member are in contact with the rotary brush so as to take off dusts twined around the surface of the rotary brush during sucking dusts. Therefore, the rotary brush is always maintained to be clean so as to reduce the frequency of maintenance of the rotary brush. If the rotary brush is used for polishing the floor, it can improve a polishing efficiency thereof.

When the suction nozzle is moved backward, the brushes come in contact with the floor so as to increase the efficiency of polishing a floor and scraping dusts a carpet and the like.

What is claimed is:

1. An electric vacuum cleaner having a suction nozzle comprising:

a nozzle body with a bottom surface, a front wall, and at least two side surfaces for housing the suction nozzle;

a dust inlet formed in the bottom surface of the nozzle body; and a rotary brush rotatably mounted in the nozzle body along said dust inlet, said nozzle body including, a flexible member, contacting a floor on which the nozzle body is moving and covering a lower portion of said front wall, the flexible member being mounted to the front wall of the nozzle body so as to pivot forward and backward in response to respective backward and forward movement of the nozzle body on the floor, the backward pivoting of the flexible member opening the lower portion of said front wall to enable suction of particles relatively large in size off the floor, and a sliding piece slidably mounted on at least one of the side surfaces of the nozzle body, the sliding piece including a portion contacting the floor, sliding backward and exposing a side opening in response to the respective forward movement of the nozzle body, to enable suction of particles relatively large in size, and sliding forward and closing the side opening in response to respective backward movement of the nozzle body, to maintain maximum suction pressure through the dust inlet.

2. An electric vacuum cleaner as claimed in claim 1, wherein said flexible member comprises a supporting shaft pivotably mounted to the front wall of said nozzle body and a sealing piece formed in a plate shape mounted to said supporting shaft, said sliding piece comprising a slidable base portion and a plate-shaped tip portion mounted substantially vertically to said base portion, said supporting shaft and said base portion being made from hard material, and said sealing piece and said plate-shape tip portion being made from flexible material.

3. An electric vacuum cleaner as claimed in claim 2, wherein said sealing piece of said flexible member has supplementary pieces formed in a plate shape and connected with said sealing piece by ribs to prevent said flexible member from moving forward when said nozzle body stops moving forward, the supplementary pieces having a length to be in contact with the floor when said flexible member moves backward.

4. An electric vacuum cleaner as claimed in claim 3, further comprising brushes disposed between said sealing piece and said supplementary pieces.

5. An electric vacuum cleaner as claimed in claim 2, further comprising brushes mounted on said plate-shaped tip portion mounted substantially vertical to said slidable base portion.

6. An electric vacuum cleaner as claimed in claim 2, wherein said supporting shaft of said flexible member is made from hard resin, said sealing piece of said flexible member being made from flexible resin, and said supporting shaft and said sealing piece being integrated by a two color injection.

7. An electric vacuum cleaner as claimed in claim 2, wherein said base portion of said sliding piece is made from hard resin having a low coefficient of friction, said plate-shaped tip portion being made from flexible resin or hard rubber.

8. An electric vacuum cleaner as claimed in claim 1, wherein said nozzle body has a depression disposed in the front wall thereof, said flexible member being detachably mounted in a groove formed in said depression.

9. An electric vacuum cleaner as claimed in claim 1, wherein said nozzle body has a rear restrictive wall mounted on the front wall thereof for stopping said flexible member at an angle not to come in contact with said rotary brush during the backward rotation of said flexible member, and has a front restrictive wall mounted on the front wall thereof for stopping said flexible member in a state of being vertical to the floor during the forward rotation of said flexible member.

10. An electric vacuum cleaner as claimed in claim 1, further comprising a rear restrictive portion mounted for restricting the backward movement of said sliding piece when the side face is completely opened during the forward movement of said nozzle body and a front restrictive portion mounted for restricting the forward movement of said sliding piece when the side face is completely closed during the backward movement of said nozzle body.

11. An electric vacuum cleaner as claimed in claim 1, further comprising a groove disposed in the side face portion of said side wall to slide said sliding piece along said side wall.

12. An electric vacuum cleaner as claimed in claim 1, wherein said flexible member has a tip and brushes mounted on the tip, said brushes contacting with said rotary brush when said flexible member rotates backward.

13. An electric vacuum cleaner as claimed in claim 12, wherein said nozzle body includes a rear restrictive wall mounted on the front wall thereof, for stopping said flexible member at an angle at which said brushes contact said rotary brush.

14. An electric vacuum cleaner as claimed in claim 1, wherein said flexible member pivots due to frictional engagement with the floor.

15. An electric vacuum cleaner as claimed in claim 1, wherein said sliding piece slides backward and forward due to frictional engagement of the floor with said portion contacting the floor.

16. An electric vacuum cleaner having a suction nozzle comprising:

a nozzle body with a bottom surface, a front wall, and at least two side surfaces for housing the suction nozzle;

a dust inlet formed in the bottom surface of the nozzle body; and a rotary brush rotatably mounted in the nozzle body along said dust inlet, said nozzle body including, a sliding piece slidably mounted on at least one of the side surfaces of the nozzle body, the sliding piece including a portion contacting the floor, sliding backward and exposing an opening in response to forward movement of the nozzle body on the floor on which the electric vacuum cleaner is placed, to enable suction of particles relatively large in size, and sliding forward and closing the opening in response to backward movement of the nozzle body, to maintain maximum suction pressure through the dust inlet.

17. The electric vacuum cleaner as claimed in claim 16, wherein said sliding piece slides due to frictional engagement of the floor with said portion contacting the floor.

* * * * *